US009982522B2

(12) United States Patent
Ibatullin

(10) Patent No.: US 9,982,522 B2
(45) Date of Patent: May 29, 2018

(54) METHOD OF DEVELOPMENT OF A DEPOSIT OF HIGH-VISCOSITY OIL OR BITUMEN

(71) Applicant: TAL OIL LTD., Calgary (CA)

(72) Inventor: Ravil Rustamovich Ibatullin, Calgary (CA)

(73) Assignee: TAL OIL LTD., Calgary (CA)

( * ) Notice: Subject to any disclaimer, the term of this patent is extended or adjusted under 35 U.S.C. 154(b) by 200 days.

(21) Appl. No.: 15/096,710

(22) Filed: Apr. 12, 2016

(65) Prior Publication Data

US 2017/0292356 A1 Oct. 12, 2017

(51) Int. Cl.
*E21B 43/24* (2006.01)
*E21B 49/08* (2006.01)

(52) U.S. Cl.
CPC ..... *E21B 43/2406* (2013.01); *E21B 49/08* (2013.01)

(58) Field of Classification Search
CPC ..... E21B 43/2406; E21B 43/24; E21B 49/08; E21B 49/008
USPC ..... 166/268, 167, 264, 272.3
See application file for complete search history.

(56) References Cited

U.S. PATENT DOCUMENTS

2015/0122481 A1* 5/2015 Janjua ..... C02F 9/00 166/75.12
2015/0198019 A1* 7/2015 Affholter ..... E21B 43/24 166/272.6
2015/0198027 A1* 7/2015 Wickramathilaka ... C09K 8/592 166/272.4
2015/0204179 A1* 7/2015 Affholter ..... E21B 43/24 166/245

FOREIGN PATENT DOCUMENTS

| | | | |
|---|---|---|---|
| RU | 2095549 | C1 | 11/1997 |
| RU | 2231787 | C1 | 6/2004 |
| RU | 2330272 | C1 | 7/2008 |
| RU | 2379494 | C1 | 1/2010 |

OTHER PUBLICATIONS

English Abstract of RU2379494 C1.
English Abstract of RU2231787 C1.
English Abstract of RU2330272 C1.

* cited by examiner

*Primary Examiner* — Michael R Wills, III
(74) *Attorney, Agent, or Firm* — Ladas & Parry LLP

(57) ABSTRACT

A method of developing deposits of high-viscosity oil or bitumen using a pair of horizontal injection and production wells. The method includes the steps of, before the formation of the wells, selecting core samples for analyzing extracted water mineralization and determining composition of dissolved elements. Based on these data, the optimum mineralization is determined in order to maximize oil recovery from the reservoir. After warming up of the reservoir and creating a steam chamber, the mineralization of produced water is determined at least once a day by directly measuring in the stream of the product. After reaching a stable value of mineralization of the produced water, the injection of the heat-transfer agent in the injection well and the withdrawal of the product from the production well without break of the heat-transfer agent in the production well is controlled so that the mineralization of the water is as much as possible close to the optimum value.

2 Claims, 2 Drawing Sheets

METHOD OF DEVELOPMENT OF A DEPOSIT OF HIGH-VISCOSITY OIL OR BITUMEN

The invention relates to the petroleum industry, namely to the methods for developing high-viscosity oil reservoirs using horizontal wells and thermal impact on the reservoir.

Patent RU 2095549 discloses a method of developing nonuniform oil reservoir, which comprises an alternation of a period of injection of water in the reservoir through an injection well and a simultaneous reservoir fluids extraction through production wells and the period of extraction of the reservoir fluids through the production wells when water is not injected through the injection well. Periodically, once in 2-3 days, produced water is analyzed to determine its mineralization. The injection of water with simultaneous extraction of the reservoir fluids is carried out to achieve a stable value of mineralization of the produced water.

The disadvantages of this method are the high material costs associated with the need to build technological well with two wellheads, the lack of consideration of the initial properties of the produced products allowing reaching the highest oil recovery coefficient, as well as analyzing produced products in remote from production locations specialized laboratories, which reduces the reliability of the results.

A method for the development of deposits of high-viscosity oil according to patent RU 2379494 is the closest analogue to the present invention. Said method uses a pair of horizontal injection and production wells, horizontal sections of which are arranged in parallel one above the other in a vertical plane of a producing reservoir. The wells are provided with tubing strings that allow simultaneous downloading of a coolant and extracting the products, download the coolant, heating producing reservoir creating a steam chamber, extracting the products through the production well through the tubing strings, and controlling technological parameters of the reservoir and the well. The end of the tubing strings are placed on opposite ends of the conventionally horizontal section of the wells. Heating of the producing reservoir starts with steam injection through both wells, heating inter-well reservoir area, reducing the viscosity of high-viscosity oil, and the vapor chamber is created by pumping the heat-transfer agent propagating to the top of the producing reservoir with an increase of the steam chamber dimensions. During the extraction of the products from time to time (2-3 times a week) mineralization of the passing water is defined, the impact of changes in mineralization of passing water on the uniform heating of the steam chamber is determined, and taking into account the changes in mineralization of passing water, uniform heating of the steam chamber by controlling the coolant injection mode or extraction of well production to achieve stable value of mineralization of the passing water.

The disadvantages of this method are the lack of consideration of the initial properties of the produced products allowing to reach the highest oil recovery, the implementation of the analysis of produced products in specialized labs, remote from the sampling point, which is produced with large periods (1 every 2-3 days), which reduces the reliability of the results.

The object of the invention is to provide a method, which allows increasing the oil recovery factor by taking into account the properties of produced fluids, increasing the number of product mineralization tests carried out directly at the well.

This object is achieved by a method of developing deposits of highly viscous oil or bitumen using a pair of horizontal injection and production wells, horizontal sections of which are arranged in parallel one above the other in a producing reservoir equipped with a tubing string allowing simultaneous injection of a heat-transfer agent and extraction of the product. The method also comprises pumping a heat transfer fluid, heating the producing reservoir with the creation of a steam chamber, extracting the product by pumps through the lower production well tubing strings, the ends of which are located on opposite ends of the conventionally horizontal section of the well. The mineralization of the simultaneously extracted water is determined, the dependence of the uniformity of the steam chamber heating is determined, and the mode of by salinity changes in passing water sample and the injection mode of the heat-transfer agent or the product extraction is adjusted to achieve a stable value of mineralization of the produced water ensuring uniform heating of the steam chamber.

According to the invention, before the construction of wells in the appraisal well, or during the construction of the wells, cores of the producing reservoir are obtained. Said cores are used for determining water mineralization and composition of the dissolved elements. Optimum mineralization of the passing water corresponding to the minimum steam-bitumen ratio is determined for obtaining maximum recovery rates of oil from the producing reservoir. After the reservoir is heated and the steam chamber is created, the mineralization of the produced water is determined at least once a day using measuring instruments directly in the flow of produced fluids. After reaching a stable value of produced water mineralization, the heat-transfer agent injection through the injection well and extracted products from the production well are adjusted so that the water mineralization approaches optimum level.

Preferably, the measuring devices are arranged on a substrate of a hydrophilic material. They are placed at the inlet of the pumps and functionally linked to the appropriate pumps to adjust the product extraction and maintain the lowest possible pressure precluding vaporization at the pump intake.

The invention is illustrated by the following drawings.

Method of developing deposits of high-viscosity oil or bitumen is implemented as follows.

Figure 1:
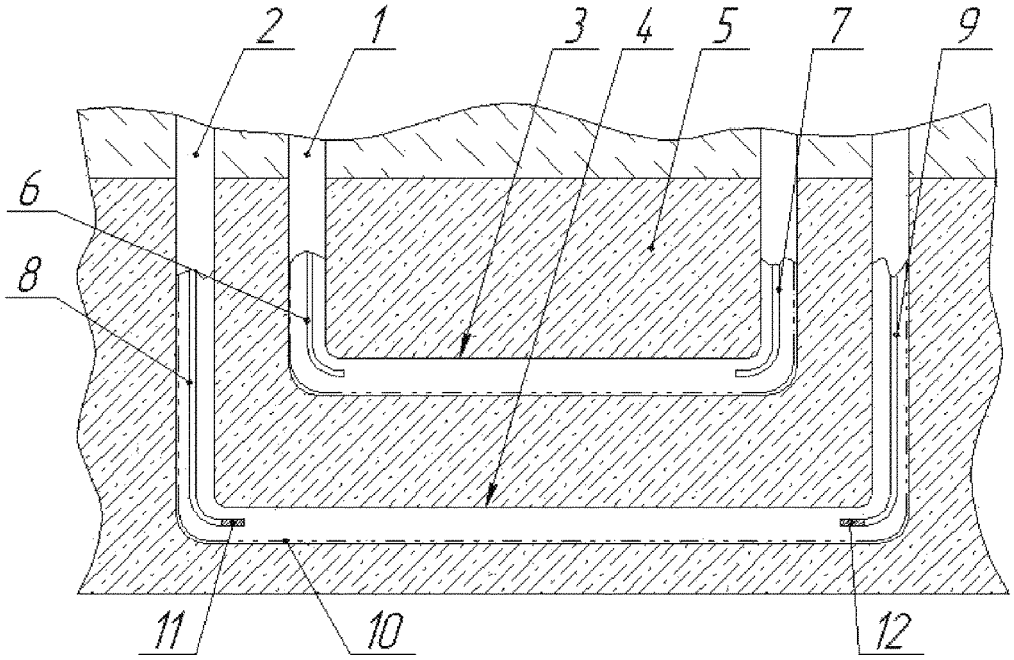
FIG. 1 shows the layout of the wells with one wellhead each.
Figure 2:
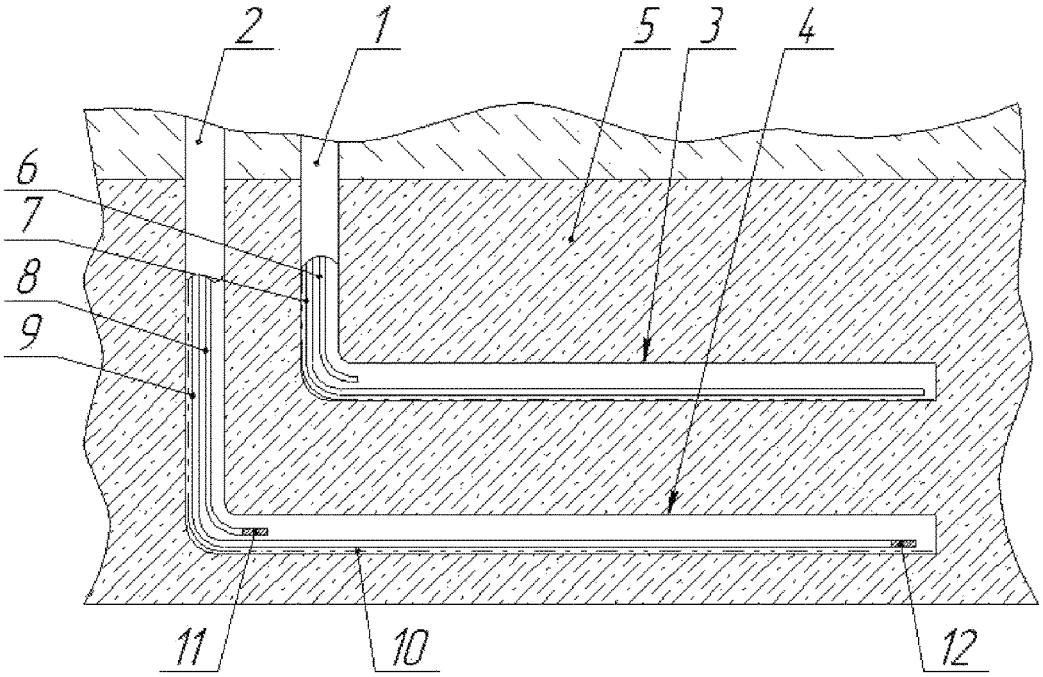
FIG. 2 shows—a layout of wells with double heads.

Before the construction of wells in the appraisal well (not shown) or during the construction of wells 1 and 2 (FIGS. 1 and 2) with the respective horizontal portions 3 and 4 a core of a production reservoir 5 is obtained for the study of the reservoir products including water mineralization and composition of dissolved elements. Based on these data, the optimal mineralization of the passing water is determined experimentally in the process of extraction in order to obtain maximum coefficient of oil recovery (COR) from the reservoir 5. The pairs of injection wells (FIGS. 1 and 2) and extracting wells are constructed so that their respective horizontal portions 3 and 4 are arranged in the production wells in formation 5 in parallel one above the other. The wells 1 and 2 can have two wellheads as shown in FIG. 1 or one wellhead as shown in FIG. 2. Furthermore, due to individual characteristics of the producing formation one of the wells may be built with two wellheads and another with one wellhead (not shown in the figures). The wells 1 and 2 are equipped with two corresponding tubing strings 6, 7 and 8, 9.

Instead of tubing strings, the wells 1 and 2 can be fitted with a continuous (flexible) pipe. The producing wells 2 along the length of its horizontal section 4 can be provided with sensors 10 for additional temperature control. The tubing strings 6 and 7 make it possible to conduct heat transfer agent injection (for example, steam or hot water), and tubing strings 8 and 9 to carry out the simultaneous extraction of products with corresponding pumps 11 and 12. The productive reservoir 5 is heated by the heat-transfer agent creating a steam chamber (not shown) above the horizontal part 4 of the production well 2. Due to convective and conductive heat transfer at the stage of development of steam injection in both wells 1 and 2, the inter-well reservoir zone (zone between the producing well 2 and injecting well 1) is heated reducing the viscosity of the high-viscosity oil. Oil thermally expands, and its mobility increases. Then in the process of production of high-viscosity oil in the injection well 1 steam is injected, which is due to the difference in density tends to move to the top of the productive reservoir 5 creating increasing in size steam chamber. On the water-oil interface of the steam chamber and the cold oil-saturated layer, heat exchange process is constantly going on, in which the steam is condensed into water and heated with heavy oil and linked with the reservoir water flows to the production well 2 by gravity.

Tubing strings 6, 7 and 8, 9 are arranged in appropriate wells 1 and 2 so as to be able to inject and extract from the respective opposite ends of the conditionally horizontal portions 3 and 4 to enable controlling mineralization of produced water from both ends of the portion 4; and to enable temperature control over the length of sections 3 and 4 by injecting heat-transfer agent and extracting products by the pumps 11 and 12 to avoid breakthrough of the heat-transfer agent from the injection well 1 to the production well 2 during extraction of products, and increasing the COR of the reservoir 5.

After heating the reservoir and creating the steam chamber, in the process of extraction from the production well 2, mineralization of produced water from the well 2 is determined not less than once a day directly in the flow of the produced fluids using measuring devices (conventionally not shown), for example sensors disclosed in documents of RU 2231787, RU 2330272 and others. Measuring devices are arranged in the pipe (not shown) pumping produced products or for more precise control of the inlets of the pumps 11 and 12. The sensors are placed on the substrate of a hydrophilic material (for example, silicates and the like) having minimum adhesion to hydrocarbon production of the reservoir 5, which allows obtaining objective measurements s of length in the long period of operation. When installing measuring devices at the inlets of the pumps 11 and 12, in the well bore or on the wellhead, they are operably linked via a control unit (not shown in the figures) with corresponding pumps 11 or 12 for controlling extraction of the product by said pumps and maintaining the lowest possible pressures excluding evaporation at an inlet of the corresponding pump 11 and 12 taking into account the mineralization. Increasing water mineralization raises its boiling temperature since the temperature of boiling of an aqueous salt solution is higher when the solution is stronger (higher mineralization). For example, if the solution contain 1% NaCl (at a pressure of 760 mm Hg, i.e. 101.325 kPa), water boils at 100.21° C.; at 2%-100.42° C.; at 6%-101.34° C.; at 15%-103.83° C.; at 18%-104, 79° C.; at 21%-106.16° C.; at 24%-107.27° C.; at 27%-108.43° C.; at 29.5%-109.25° C., etc. For other salts or their combinations, these data can vary. Therefore, dependence of the boiling point of water on water mineralization and pressure is determined for each field after the analysis of the cores obtained while drilling the productive formation of the reservoir 5. With increasing mineralization, pumps 11 and 12 can operate in a wider range and reduce the pressure at the pump inlet of the pump 11 or 12 to lower values (to increase efficiency of the pump 11 or 12 to reduce the mineralization) as according to Clausius-Clapeyron equation with increasing pressure, the boiling point increases, and with decreasing pressure, the boiling point decreases respectively.

$$T_{boil} = \left( \frac{1}{T_{boil,aim}} - \frac{R \cdot \ln\left(\frac{P}{P_{aim}}\right)}{\Delta H_{boil} \cdot M} \right)^{-1} \tag{1}$$

wherein $T_{boil}$ is the boiling point at the inlet of the pump 11 or 12, K;

P is the pressure at the inlet of the pump 11 or 12, kPa;

$P_{atm}$ is the atmospheric pressure (accepted as 101.325 kPa), kPa;

$T_{boil.atm.}$ is a boiling point at atmospheric pressure, K;

$\Delta H_{boil}$ is specific heat of evaporation, J/kg:

M is molar mass, kg/mol;

R is universal gas constant.

This relationship previously before the operations is introduced into the control unit (controller) of the pumps 11 and 12 to prevent vaporization at the pump inlets due to changes in mineralization of produced water.

After achieving equilibrium, the mineralization of water pumped by the pumps 11 and 12 of the production well 2 is brought most approximate to the optimal mineralization determined based on the core study by controlling the heat-transfer agent injection through the tubing strings 6 and 7 in the injection well 1, and the extraction of products from the production well 2 by pumps 11 and 12 through the tubing strings 8 and 9 without a breakthrough of the heat-transfer agent in the production well 2.

The mineralization of the reservoir water decreases when it is mixed with the condensate, and the mineralization of the produced water has an intermediate value.

When there is steady injection and extraction, there is an equilibrium relationship between the amount of extracted oil and the mineralization of the produced water with the subsequent adjustment of the withdrawn products and steam injection taking into account the optimal mineralization obtained in the study of the core. The temperature at the initial stage is controlled in the production well 2 by the temperature sensors 10 to prevent steam breakthrough in the production well 2. Then a stable value of mineralization is set as close as possible to the optimum value without a steam breaking in operation of the pumps 11 and 12. This mineralization is called the equilibrium value of mineralization for the determined product temperature. Violation of this balance is indicated by the change in produced water mineralization in samples from the pumps 11 or 12, while maintaining the product temperature. In the process of production, mineralization of the water periodically, at least once a day, is determined, changes in the samples are analyzed, and dependence of extraction of the high-viscosity oil on produced water mineralization is shown in the figure.

Figure 3:
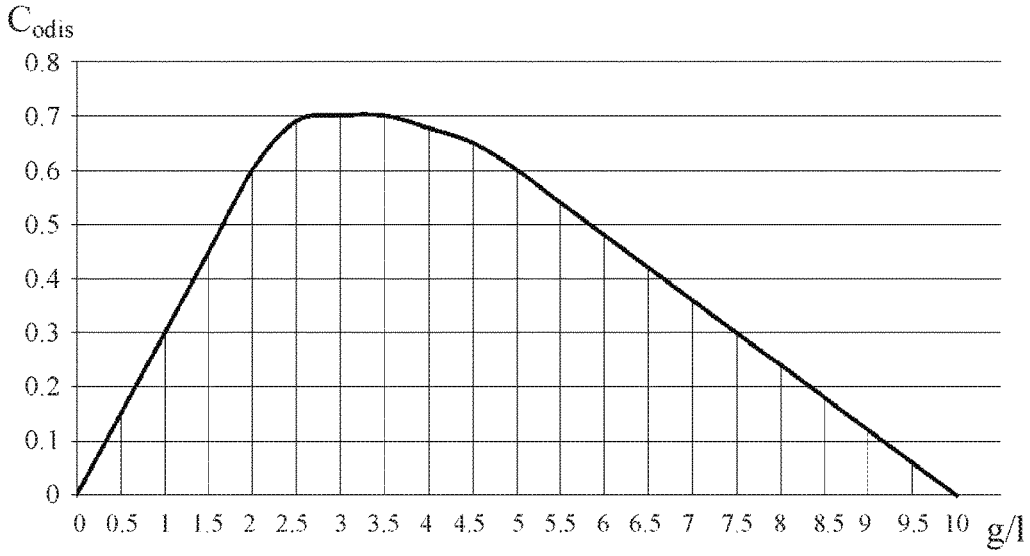
FIG. 3 is a graph of the coefficient of oil displacement ($C_{odis}$) due to mineralization (M) of passing water at Ashalchinskoye deposit at a temperature of 100° C.

As follows from the graph (FIG. 3), at produced product temperature of 100° C. with proper selection of the produced water mineralization, the displacement efficiency approaches the value of 0.7 (70% in a thermal action portion) taking into account the coverage factor (Cot) for steam and gravity action on the reservoir 5 (FIGS. 1 and 2) is approximately 0.8 (80% of the reservoir element allocated for a pair of wells 1 and 2) the maximum oil recovery coefficient (COR) is equal to 56% according to the formula:

$$COR=C_{vyt}\cdot C_{ohv}-100\% \quad (2)$$

Thus, the extraction at the optimal mineralization of the produced water can significantly increase the COR of the productive reservoir 5.

Increasing mineralization of produced water more than by 10% compared to the equilibrium value of mineralization at predetermined temperature indicates an increase in the extraction of the reservoir water with a temperature in the range of 5–15° C. As a result, the temperature reduction can take place near the production well 2 and inter-well zone, which leads to uneven warming of the steam chamber and reducing coverage of the reservoir with thermal action Reducing temperature near the production well and inter-well area leads to increased viscosity of the produced high-viscosity oil, which in turn reduces the quantity of produced high-viscosity oil and consequently reduces the effectiveness of the thermal action in general.

For reducing the mineralization of the produced water and raise the temperature near the production well 2 and in cross-well area and thereby increase the uniformity of warming up of the steam chamber (not shown in figures), it is necessary to increase the amount of steam injection through the injection well 1 or to reduce extraction of the product by respective pumps 11 and/or 12. In this case, the amount of produced water also decreases. With increase in steam injection volume, the stable heating of all the steam chamber increases in stable warm all the steam chamber volume and stops further reducing the temperature near the production well 2 and inter-well area. In this case, also, the produced water is diluted by the discharged condensate, and the mineralization of the produced water is reduced. After recovery uniformity of the heating of the steam chamber, again an equilibrium between the amount of extracted high-viscosity oil and mineralization of the produced water taking into account the optimal mineralization at predetermined temperature, but not necessarily at the same level, as evidenced by the graph of dependence of extraction of the high-viscosity oil on the mineralization of the produced water.

Reduction of the mineralization of the produced water by more than 10% compared to the equilibrium value also indicates uneven heating of the steam chamber since in such situation there is a premature breakthrough of steam to the production well 2. This leads to unproductive consumption of steam and, therefore, to increase of energy costs. Breakthrough of steam to the production well 2 can also lead to break down of technological equipment due to exposure to high temperatures. In this regard, when mineralization of produced water reduces at a predetermined temperature, it is required to reduce the volume of injected steam or to increase product extraction. With the increase in product withdrawal, the volume of extracted cold water of the reservoir with increased mineralization also increases, and therefore the mineralization of passing water increases. Since the temperature of the reservoir water, as said above, is about 5-15° C., increasing in its withdrawal will reduce the temperature near the production well and in the inter-well area. Increase in product extraction continues until the equilibrium between the amount of extracted high-viscosity oil and mineralization of produced water. Setup of equilibrium at a predetermined temperature is judged by the graph of the high-viscosity oil production and the mineralization of produced water.

Increasing the frequency of the control samples up to 1 sample per day (as minimum, the best is online mode) allows you to respond more quickly to changes in mineralisation (steam chamber temperature), thus reducing the loss of steam of up to 10% in a breakout, eliminate supercooling of the steam chamber that, as a consequence, eliminates the costs up to 15% for an additional heating of the steam chamber caused by these processes and to increase the coverage by the heat exposure.

It is found that the oil production rate significantly correlate with the temperature at the wellhead and the total mineralization of the produced water, wherein the flow rate is proportional to the temperature of the produced fluid (T, ° C.), and inversely proportional to the mineralization (M, g/l):

$$Q_{gs}=0.21T-1.38M-4.33 \quad (3)$$

The correlation coefficient of the model reflects a 79% production rate variability HS. The standard error is equal to 2.6, and its value can be used in setting the boundaries of the predictions for new observations.

By controlling the oil production and steam injection, steam/oil ratio (SOR) is evaluated. Said ratio should be maintained at the lowest possible level in order to reduce the cost of steam:

$$SOR=Q\text{steam}/Qgs \quad (4)$$

Monitoring uniformity of heating steam chamber using temperature sensors 10 is disclosed in prior art. However, due to their frequent failures, the effectiveness of the control over the process decreases.

It follows from the foregoing that the method of developing high-viscosity oil deposits allowing carrying out the control of the heat-transfer agent injection and extraction of products based on the analysis of the produced water mineralization is a very simple and effective way to control the uniformity of the steam chamber heating and increasing the efficiency of the oil recovery from high-viscosity oil deposits.

EXAMPLES OF SPECIFIC EMBODIMENT

Example 1

On the experimental plot Ashalchinskoye high-viscosity oil field is located at a depth of 90 m, represented by heterogeneous layers of 20-30 m thick at a temperature of 8° C. and pressure of 0.5 MPa. A pair of horizontal two head wells 1 and 2 (FIG. 1) including an injection well 1 and production well 2 were drilled. Corresponding horizontal sections 3 and 4 of the wells were arranged in parallel one above the other in the vertical plane of the production reservoir 5 and equipped with the appropriate tubing strings 6, 7, 8, and 9 configured for simultaneous injection of the heat-transfer agent and product extraction from various ends of the respective horizontal sections 3 and 4. At the inlets of the pumps 11 and 12 sensors for determining the mineralization of the produced water were installed. During the construction of wells cores were extracted from the productive reservoir 5, said cores showed that the reservoir has oil saturation of 0.70, a porosity of 30%, permeability of 2.65 $\mu m^2$. The oil had a density of 960 $kg/m^3$ and a viscosity of 22000 mPa·s, and water had water mineralization of approximately Cpv=10 g/l. Mineralization of steam and condensate, respectively, close to zero, i.e. $C_H$<<1 g/l. The mineralization of the produced water may vary in the range from 1 to 10 g/l depending on the stage of development of high-viscous oil reservoir 5. Based on the properties of the reservoir 5, the volume of stream injected into the well 1, temperature and volume of extracted products, it was determined according to formula 3 (based on the experience of operation of such wells of the same deposit) that the greatest amount of extracted oil can be obtained from the reservoir 5 at a temperature of the extracted product of about 97° C. and at the optimum mineralisation of the produced water of 2.4 g/l. Prior to the operation of the horizontal well 2, the inter-well area was heated by simultaneous circulation of steam in each of the wells 1 and 2. In the process of production of the high-viscosity oil, steam is injected through the injection well 1. Steam extends upwards and creates increasing in size steam chamber. In the process of product extraction mineralization of the produced water is periodically (once a day) determined at the inlets of the pumps 11 and 12. Determined also dependence of the oil production on mineralization of produced water. At the initial stage of development of the deposit of the high-viscosity oil an equilibrium is set up between the amount of the high-viscosity oil produced and the mineralization of the produced water at a temperature of about 100° C., which indicates the uniformity of warm of the steam chamber heating. The high-viscosity oil output by pumps 11 and 12 was 12.2 $m^3$/day (SOR 3.7), the mineralization varied in the range of 2.1-2.4 g/l. Equilibrium (average) value of mineralization was 2.2 g/l. Extraction by the pumps 11 and 12 was increased to a value that excludes evaporation at the inlet of the pumps 11 and 12 for approximation to the optimum mineralization. Production rate increased to 12.8 $m^3$/day (approximately by 5%), and the mineralization 2.3 g/l at the inlets of both pumps 11 and 12 (SOR 3.5). After 34 days of well operation, analysis of mineralization of the produced water at the pump 11 inlet showed that there was increase in mineralization from 2.3 g/l to 3.1 g/l, or 34.8%, while the production of high-viscosity oil decreased on this pump from 6.4 $m^3$/day to 3 $m^3$/day (total SOR 5.1). This suggests that the increased inflow of cold reservoir water, which helped reducing the temperature, increasing mobility of the high-viscosity oil, and reducing the uniformity of heating the steam chamber. The amount of steam injection at that point was 45 $m^3$/day. On the base of the analysis, it was decided to increase the volume of steam injection to 55 $m^3$/day for 5 days. Extraction of the product by the pump 11 was reduced by half, and by the pump 12 was increased by 10% without steam formation at the inlet of this pump for pressure at the inlet of this pump was not less than 100 kPa. The total oil production decreased to 9.8 $m^3$/day (SOR 5.6), rather than up to 6 $m^3$/day (as in similar wells operated in accordance with the closest analogue). After that in 3 days the mineralization of the produced water at the pump 11 intake began to decline and reached a value of 2.28 g/l, and the production of the high-viscosity oil also increased to 11.3 $m^3$/day (SOR 04.9). The intensity of extraction by the pump 11 was returned to the initial condition, while for the pump 12 it was lowered by 10%. Then, there was stabilization of the high-viscosity oil production at the level of 11.3 $m^3$/day (4% more than in similar wells of the same deposit), and mineralization changed slightly in the range of 2.28-2.4 g/l, which corresponds to the average value of 2.34 g/l at a temperature of extracted products equal to 75° C., which close to the optimal value, which was maintained by adjusting extraction of the product by the 11 and 12. Later, the temperature increased to 100° C., while the total production was 13 $m^3$/day (SOR 4.2) with mineralization of water of 2.7 g/l (which is the optimum value for such flow rate and temperature).

After 32 days, mineralization of the produced water increased from 2.7 g/l to 3.5 g/l (an increase of 23% at a product temperature of 70° C.). Average daily production of the high-viscosity oil decreased from 13 $m^3$/day to 10.2 $m^3$/day (SOR 5.4), which indicated that the steam chamber was cooling. The extraction of the produced water was reduced from 100 $m^3$/day to 88 $m^3$/day for aligning the uniform heating of the steam chamber. After that, within 4 days the mineralization of the produced water again began to decline gradually reaching the value of 2.8 g/l, the extraction of the high-viscosity oil at the same time began to increase and stabilized at around 12.9 $m^3$/day (SOR 4.3) at the product temperature of 100° C. COR was 45%, which is 15% more than that of the closest analogue.

Example 2

On the experimental plot of the Ashalchinskoye high-viscosity oil deposit located at a depth of 90 m, represented by heterogeneous layers of 20-30 m thick with a temperature of 8° C. and pressure of 0.5 MPa a pair of horizontal one-head wells 1 and 2 (FIG. 2) was drilled. Said pair consists of an injection well 1 and a production well 2, corresponding horizontal sections 3 and 4 of which are arranged in parallel one above the other in vertical plane of the producing reservoir 5 and equipped with the appropriate tubing strings 6, 7, 8, and 9 allowing simultaneous injection of a heat-transfer agent and product extraction at different ends of the corresponding horizontal sections 3 and 4. At the mouth of the outlets of the pumps 11 and 12 sensors that determine the mineralization of the produced water were arranged on a hydrophilic substrate. During construction of the appraisal well (not shown in FIG. 2), cores were produced from the reservoir 5, which showed that the reservoir has oil saturation of 0.70, a porosity of 30%, permeability of 2.65 $\mu m^2$. The oil had a density of 960 kg/$m^3$ and a viscosity of 22,000 mPa·s, and water having a mineralization of approximately Cpv=10 g/l. Mineralization of steam and condensate respectively is close to zero, i.e. Cs.<<1 g/l. Mineralization of reservoir water can reach Cr.w.=10 g/l. Mineralization of the produced water may vary in the range from 1 to 10 g/l depending on the stage of development of the high-viscose oil reservoir 5. Based on the properties of the reservoir 5, the volume of injected steam into the well 1, the temperature and the volume of extracted products (derived from the operation of such wells of the same deposit), it was found from the formula (2) that the greatest amount of the produced oil from the reservoir 5 would be at the optimum mineralization of the produced water of 3.3 g/l. During operation, the equilibrium relationship between the amount of produced high-viscosity oil (13-13.8 $m^3$/day) and mineralization of produced water (3.58-3.45 g/l) at a temperature of extracted products equal to 100° C., and the volume of the injected steam of 80 $m^3$/day was achieved. The equilibrium (mean) value of the mineralization was 3.52 g/l. However, for such a flow rate, the optimum mineralisation was determined by core analyzes as 3.3 g/l. the extraction intensity was increased at the pumps 11 and 12 by 5%. As a result, the total flow rate was 14 $m^3$/day (4% up), and the average mineralization was 3.3 g/l (SOR 5.7). After 32 days of operation, within 3 days the mineralization at the inlet of the pump 12 dropped dramatically and reached a value of 2.1 g/l. The change in mineralization amounted to 33% of the equilibrium value, and the product temperature increased to 120° C. This showed that there was premature breakthrough of steam to the production well 2 resulting in lower exposure of the reservoir, reduction of the uniformity of the steam chamber heating and unproductive use of the heat-transfer agent. For normalizing the mineralization and consequently the temperature near the production well, the extraction of liquid by the pump 12 was increased from 43 $m^3$/day to 49 $m^3$/day. The mineralization normalized in 9 days and was 3.4 g/l. The value of liquid extraction by the pumps 11 and 12 was made equal, and the total amount was at the level of 97 $m^3$/day. The extraction of the high-viscosity oil at first decreased after the steam breakdown, and then stabilized after increasing extraction rate and remained at 14.2 $m^3$/day (3% higher than on similar wells) at the temperature of 110° C. (SOR 5.6). After three months of operation due to the steam breakdown the mineralisation of produced water at the inlets of both pumps 11 and 12 decreased (to 2.1 g/l), and the flow rate of the high-viscosity oil decreased (to 11 $m^3$/day) at the temperature of products at 87° C. (SOR 7.3). The amount of steam injection was decreased from 80 $m^3$/day to 65 $m^3$/day to restore the balance. The average mineralization for 4 days at both pumps 11 and 12 increased to a value of 3.3 g/l and subsequently remained at this level at a product temperature of 90° C. The extraction of the high-viscosity oil gradually increased to a value of 14.1 $m^3$/day (SOR 4.6). COR was 42%, which is 12% higher than that of the closest prior art.

The described method of developing deposits of high-viscosity oil or bitumen using a pair of horizontal injection and production wells can increase oil production by 3-5%, and recovery factors by 10-15% at comparable values of steam/oil ratio by increasing the number of analyzes of the produced water mineralization and approximating the mineralization of the produced water to the optimal one determined from the analysis of cores taken directly from this productive reservoir.

The invention claimed is:

1. A method of developing a reservoir of high-viscosity oil or bitumen using a plurality of horizontal wells, comprising an upper injection well and a lower production well each of which has a horizontal section, wherein the wells are disposed parallel one above the other in a productive reservoir, each of said wells being equipped with tubing strings that allow for simultaneous injection of a heat-transfer agent and extraction of product, said method including the steps of:

(a) obtaining a core sample of the productive reservoir from a time before or during drilling of the wells and analyzing the core sample to determine a mineralization of extracted water produced from the productive reservoir and a composition of components dissolved in the extracted water produced from the productive reservoir;

(b) determining from the analysis in step (a) an optimum mineralization of water produced from the productive reservoir corresponding to a minimum steam/bitumen ratio for obtaining a maximum oil recovery from the productive reservoir;

(c) injecting the heat-transfer agent into the injection well to cause heating of the productive reservoir and formation of a steam chamber;

(d) after heating the reservoir and formation of the steam chamber, extracting product from the lower production well and determining a mineralization of produced water in the extracted product at least once a day using measuring devices directly in the flow of the extracted product;

(e) controlling injection of the heat-transfer agent or extraction of product from the wells to achieve a stable value of mineralization of the produced water for ensuring uniform heating of the steam chamber; and (f) after achieving a stable value of mineralization of the produced water, controlling injection of the heat-transfer agent in the injection well and withdrawal of product from the production well to avoid a break of the heat-transfer agent in the production well so that the mineralization of the produced water is as close as possible to the optimum mineralization of water determined in step (b).

2. The method according to claim 1, wherein the product is extracted in step (d) using pumps disposed at opposite ends of the lower production well and the measuring devices are disposed on a hydrophilic substrate at inlets of the pumps, in a wellbore or at a wellhead, and wherein each of the measuring devices is operably linked to a corresponding pump to control the extraction of the product and to maintain the lowest possible pressure excluding vaporization at the inlets of the pumps.

* * * * *